US006652054B2

(12) United States Patent
Regev et al.

(10) Patent No.: US 6,652,054 B2
(45) Date of Patent: Nov. 25, 2003

(54) TABLE AND A MOTION UNIT FOR ADJUSTING THE HEIGHT THEREOF

(75) Inventors: Sharon Regev, Ramat Ha'sharon (IL); David Feiner, Ra'anana (IL)

(73) Assignee: Aprion Digital Ltd., Netanya (IL)

( * ) Notice: Subject to any disclaimer, the term of this patent is extended or adjusted under 35 U.S.C. 154(b) by 64 days.

(21) Appl. No.: 09/982,879

(22) Filed: Oct. 22, 2001

(65) Prior Publication Data

US 2002/0044811 A1 Apr. 18, 2002

Related U.S. Application Data

(63) Continuation-in-part of application No. 09/495,726, filed on Feb. 1, 2000.
(60) Provisional application No. 60/242,141, filed on Oct. 23, 2000.

(51) Int. Cl.[7] ..... B41J 25/308
(52) U.S. Cl. ..... 347/8
(58) Field of Search ..... 347/8, 19, 37, 347/104, 14, 23, 101–102, 105–106; 400/55, 23, 35

(56) References Cited

U.S. PATENT DOCUMENTS

| | | | | |
|---|---|---|---|---|
| 5,345,863 A | * | 9/1994 | Kurata et al. | 101/126 |
| 5,499,876 A | | 3/1996 | Hosokawa et al. | 400/56 |
| 5,854,643 A | | 12/1998 | Katsuyama | 347/8 |
| 5,940,092 A | | 8/1999 | Kashimura et al. | 347/8 |
| 6,002,891 A | | 12/1999 | Shin | 399/45 |

FOREIGN PATENT DOCUMENTS

JP 4-216971 8/1992

* cited by examiner

*Primary Examiner*—Raquel Yvette Gordon
*Assistant Examiner*—Charles W. Stewart, Jr.
(74) *Attorney, Agent, or Firm*—Eitan, Pearl, Latzer & Cohen Zedek, LLP.

(57) ABSTRACT

In some embodiments of the present invention, a method and apparatus for adjusting the height of a platform having a substrate thereon in order to adjust the distance between the substrate and an ink-jet print head located above is provided. In other embodiments, an apparatus for the step-wise conveyance of materials is provided. It comprises a support structure for the material being conveyed and movable and fixed elements for applying forces for temporarily engaging the conveyed material to the support structure.

11 Claims, 10 Drawing Sheets

TABLE AND A MOTION UNIT FOR ADJUSTING THE HEIGHT THEREOF

CROSS-REFERENCE TO RELATED APPLICATIONS

The present application is a continuation in part of U.S. patent application Ser. No. 09/495,726, filed Feb. 1, 2000 and claims priority from U.S. provisional application Ser. No. 60/242,141, filed Oct. 23, 2000.

BACKGROUND OF THE INVENTION

Industrial printers are typically large format machines capable of printing on different substrates of variable sizes and thickness. These printers may be suitable for printing, for example, paper having a thickness of tenth of a millimeter and cardboard sheets having a thickness of 8–9 mm. The substrate is placed on a large format table and moves along the X-axis. In order to ensure the quality of printing, the print head moves along the Y-axis in close proximity, typically one to two millimeters, to the substrate.

Fox each substrate, it is desirable to adjust the distance between the print head and the upper surface of the substrate according to its thickness. The adjustment of that distance may be achieved by either moving the print head or the table in a vertical direction. Moving the print head, however, may adversely affect the quality of printing.

Printing machines usually have mechanisms for conveying print material. In wide-format digital printing machines operating in step-mode, and in particular high-resolution printing machines, a need currently exists for a mechanism to move a substrate forward while maintaining accurate register.

The use of a vacuum table for moving a substrate is known. The continual disconnecting and reconnecting of the print material from and to the table leads, however, to a cumulative loss in registration accuracy.

DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
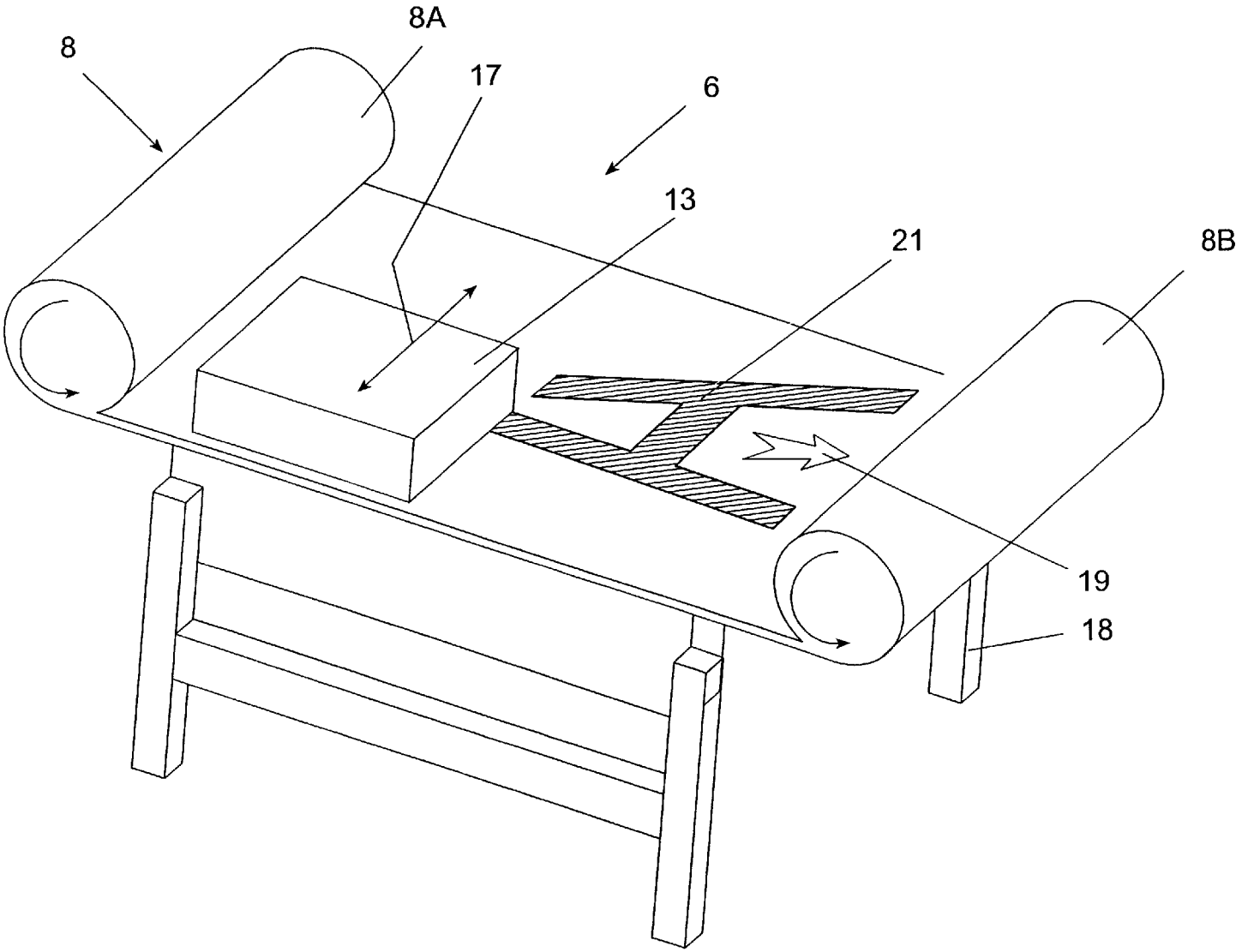
FIG. 1A is a schematic isometric view of a printing machine according to some embodiments of the present invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

According to some embodiments of the present invention, which will be described hereinbelow with respect to FIGS. 1–6, an apparatus for the step-mode conveyance of a substrate placed on a table while maintaining accurate registration is described. In other embodiments, which will be described hereinbelow with respect to FIGS. 7–8, an apparatus for adjusting the height of a table having a substrate thereon in order to adjust the distance between the substrate and a print head located above it is described.

FIG. 1A is a schematic isometric view of a table-like structure 6 according to some embodiments of the invention. A web 8 may be stored in a bearing (not shown) mounted roll 8A. The web may be attached to the upper face of the table 6 and may be rewound at the output end on a take-off roll 8B. The printing head 13, here an inkjet printer, may be movable across the web on accurate linear rails and carriages mechanically registered to the table structure 6. The rails and carriages are not shown and are not part of the present invention. The inkjet head 13 may print while moving both forward and backward across the web 8 in a direction 17 transverse to the direction 19 of motion of the web 8. A printed letter "A" 21 is shown.

Figure 1B:
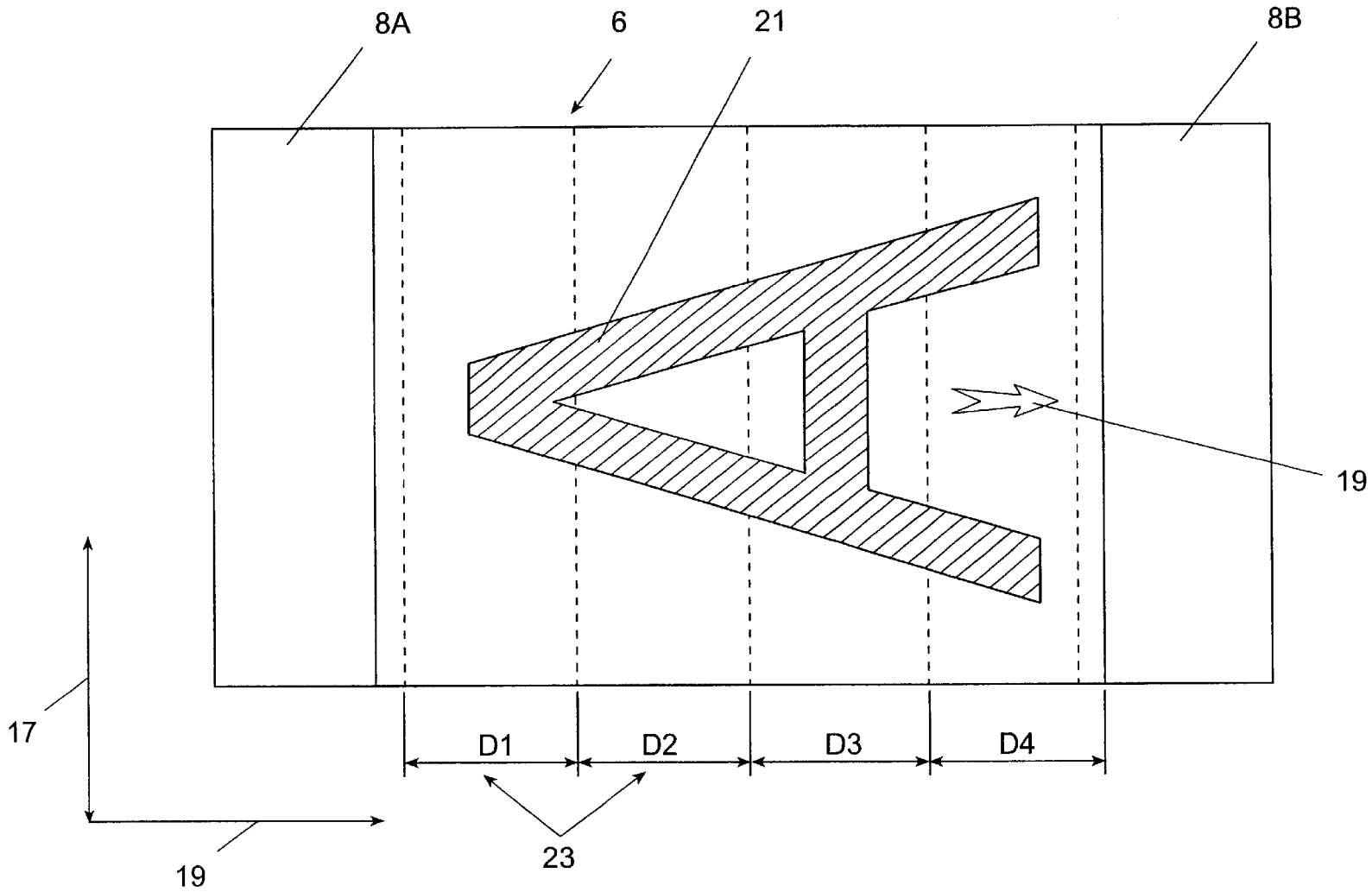
FIG. 1B is a schematic top view of a sample printed on the machine of FIG. 1A, helpful in understanding some embodiments of the present invention.

FIG. 1B is a top view of a printed image 21. The letter "A" is printed by printing head 13 (not shown in FIG. 1B) while shuttling in direction 17. The web material 8 is sequentially advanced in accurate steps of length D 23 in the direction 19. This latter direction 19 is perpendicular to the direction 17 of the motion of the print head.

Figure 2:
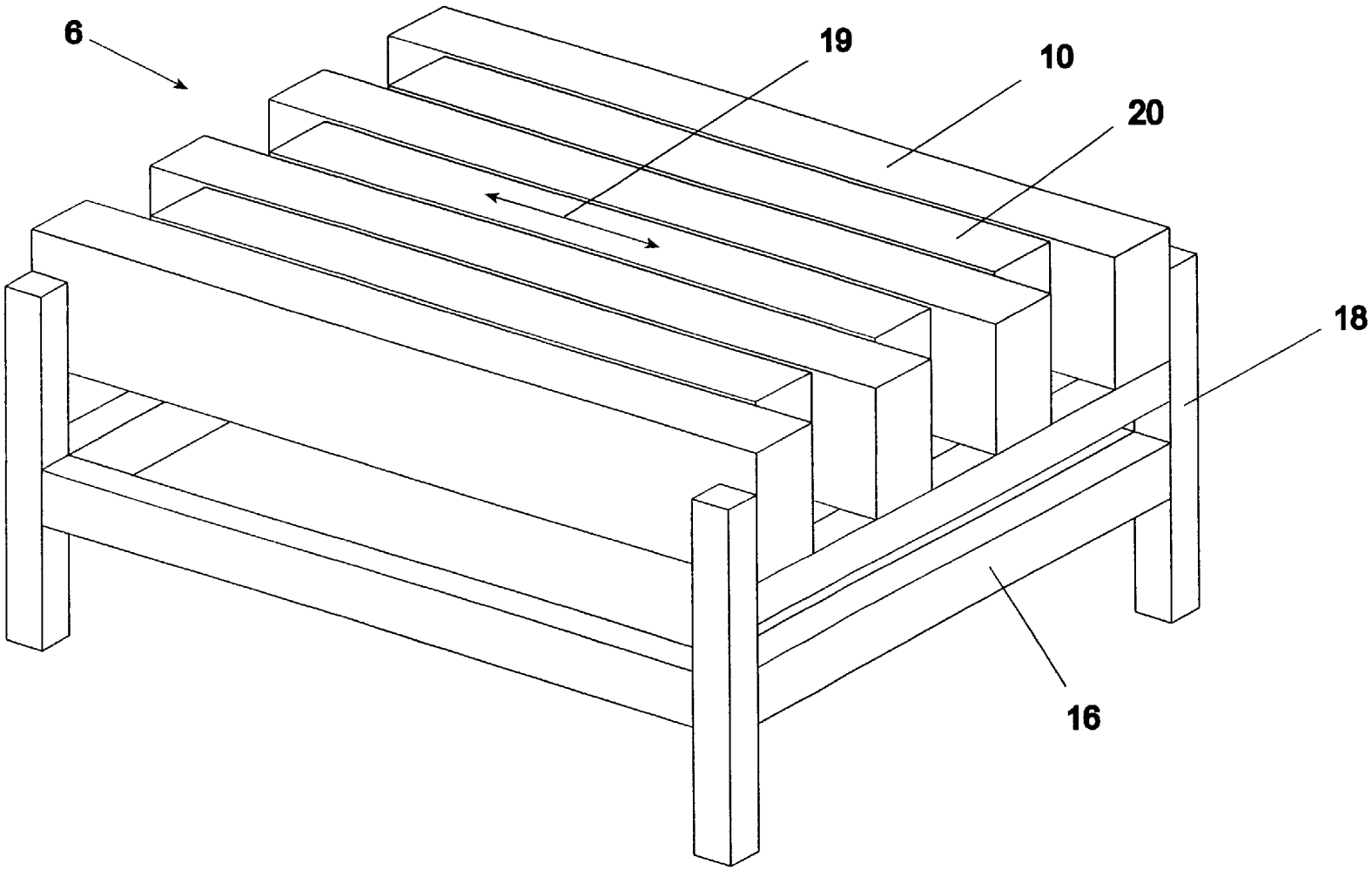
FIG. 2 is a schematic isometric view of the table-like structure according to some embodiments of the present invention.

Reference to FIG. 2 shows the table frame 16, legs 18, fixed elements 10 and movable elements 20. In the present embodiment, the elements are beams. For clarity, the web as well as the rails and linear motor are not show in the Figure.

Figure 3:
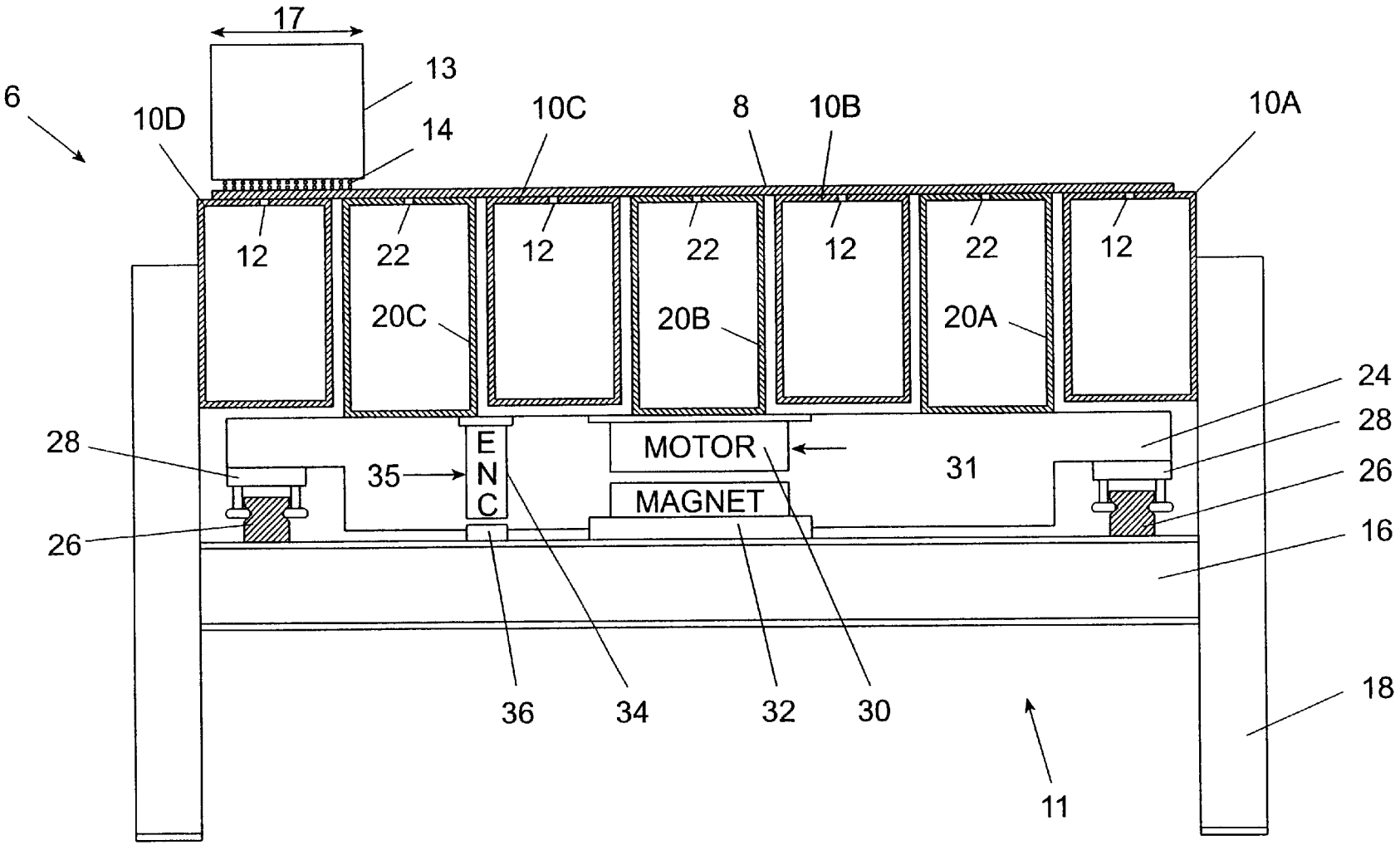
FIG. 3 is a cross section view through the table-like structure according to some embodiments of the present invention.

FIG. 3 shows a cross section of table 6 according to some embodiments of the present invention. Table 6 may comprise an array of typically rectangular, metallic, hollow shapes 10 attached at their ends to frame beams (not shown) and table legs 18. Four fixed longitudinal elements 10A to 10D are shown, although the number of elements required may vary according to the width of the table and the width of the elements. While the elements shown are rectangular, in other embodiments they can have other shapes.

Between each pair of fixed longitudinal elements 10 is a movable element 20. Here, the movable elements 20A to 20C are also metallic, hollow and rectangular. In order to hold the moving web securely, as discussed below, there usually will be a number of fixed and movable elements, with the fixed elements 10 (shown in FIGS. 2 and 3) at the extreme positions of the array. It is preferable, although not essential, that the elements be hollow. This reduces the element's weight, permitting easier movement.

The movable elements 20 may be mounted on cross beams 24 to form a grate-like array. Cross beams 24 may be mounted on carriages 28 which are movable on two parallel rails 26. In other embodiments, a single rail or more than two rails could be used. Such carriages 28 and rails 26 are well known in the art and, for example, may be those manufactured by THK Co. Inc of Tokyo.

According to some embodiments of the present invention, the rectangular elements 10, 20 are made of a lightweight, highly rigid aluminum alloy, so as to provide the rigidity necessary for the accuracy of the system. However, it should be understood that any rigid material is suitable including extruded molded plastics.

There may be three pairs of openings on each element 10, 20, which may be used to transmit the vacuum. These are shown schematically in FIG. 3 as openings 12, 22 on the fixed and moveable elements respectively. One opening of each pair is located at each end of the element. A groove (not shown) running the length of the element connects each such pair of openings. These grooves may enhance the vacuum transmitted through the vacuum inlets.

While the current configuration uses three pairs of openings per element, other configurations may have a different number. The exact number of pairs depends on the nature and weight of the print material being transported. In some embodiments, the grooves suggested may be absent; in others, the openings 12, 22 may be positioned closer to the middle of the elements.

While the above embodiments use paired openings on each element for transmitting the vacuum, other embodiments may employ an odd number of openings or even a single opening for conveying the vacuum. In the latter case, the single opening may be situated anywhere on the element.

The upper faces of the movable elements 20 and the upper faces of the fixed elements 10 are machined and aligned to lie in the same plane. The movable element 20 array is driven by a linear motor 31 comprised of a wound coil 30 typically attached to the moving part and a magnet plate 32 attached to the base plate 16. One suitable linear motor is available from Anorad Co. of Hauppauge, N.Y., part number LCK-5-3, but such motors are readily obtainable from many other manufacturers as well. While the present embodiment uses a linear motor, other methods for driving mechanical structures can also be used. These include belts, ball screws, and pneumatic devices, among others.

A closed-loop control system may allow for precision steps. The feedback for the control system is supplied by a linear encoder 35 comprised of two parts, a reader 34, which according to the present embodiment is attached to a movable element 20, and an encoder scale 36, which is attached to the fixed table. Many types of encoders are known in the art; Heidenhain Co. of Traunreut, Germany produces one such linear encoder.

While a linear encoder 35 is used to monitor movement within the apparatus described, other devices may also be used. Such devices may include rotary encoders, optical sensors and limit switches.

The web print material 8 (cross section shown) moves over the upper face of elements 10 and 20. The print head, here an inkjet print head array 13, is mounted above web print material 8 and ink droplets 14 are ejected in a controlled mode to create the image. Printing occurs while head 13 shuttles across the web 8 in the direction indicated by arrow 17.

In these embodiments, a vacuum system may be used to attach the print material to the movable and fixed elements. Alternatively, other attachment systems may be used, including but not limited to, electrostatic or magnetic systems.

Figure 4:
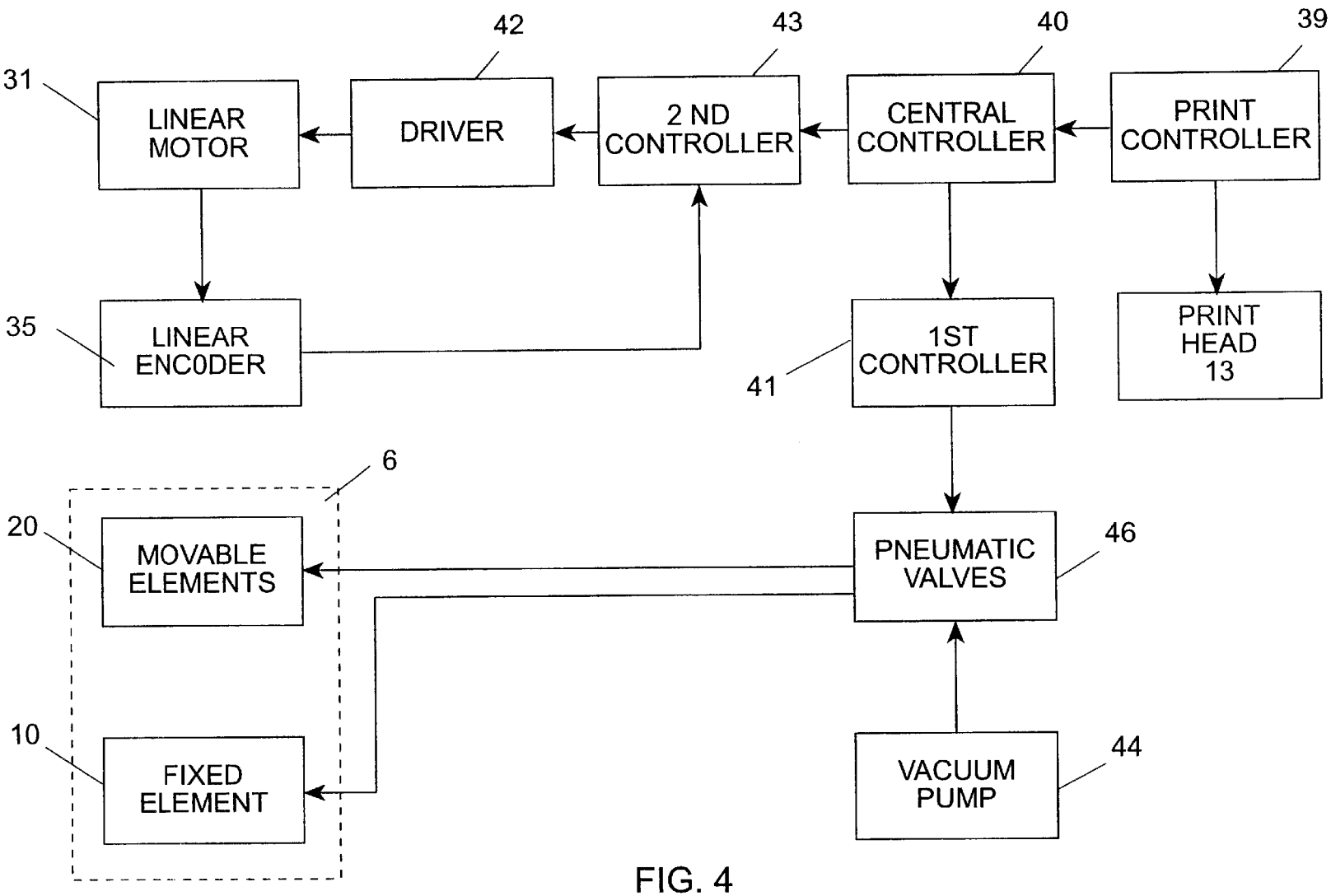
FIG. 4 is a block diagram of a control and operation system of the table-like structure according to some embodiments of the present invention.

FIG. 4 is a block diagram of the control and operation system of table 6 according to some embodiments of the present invention. A typical operation cycle is described as follows.

Figure 6:
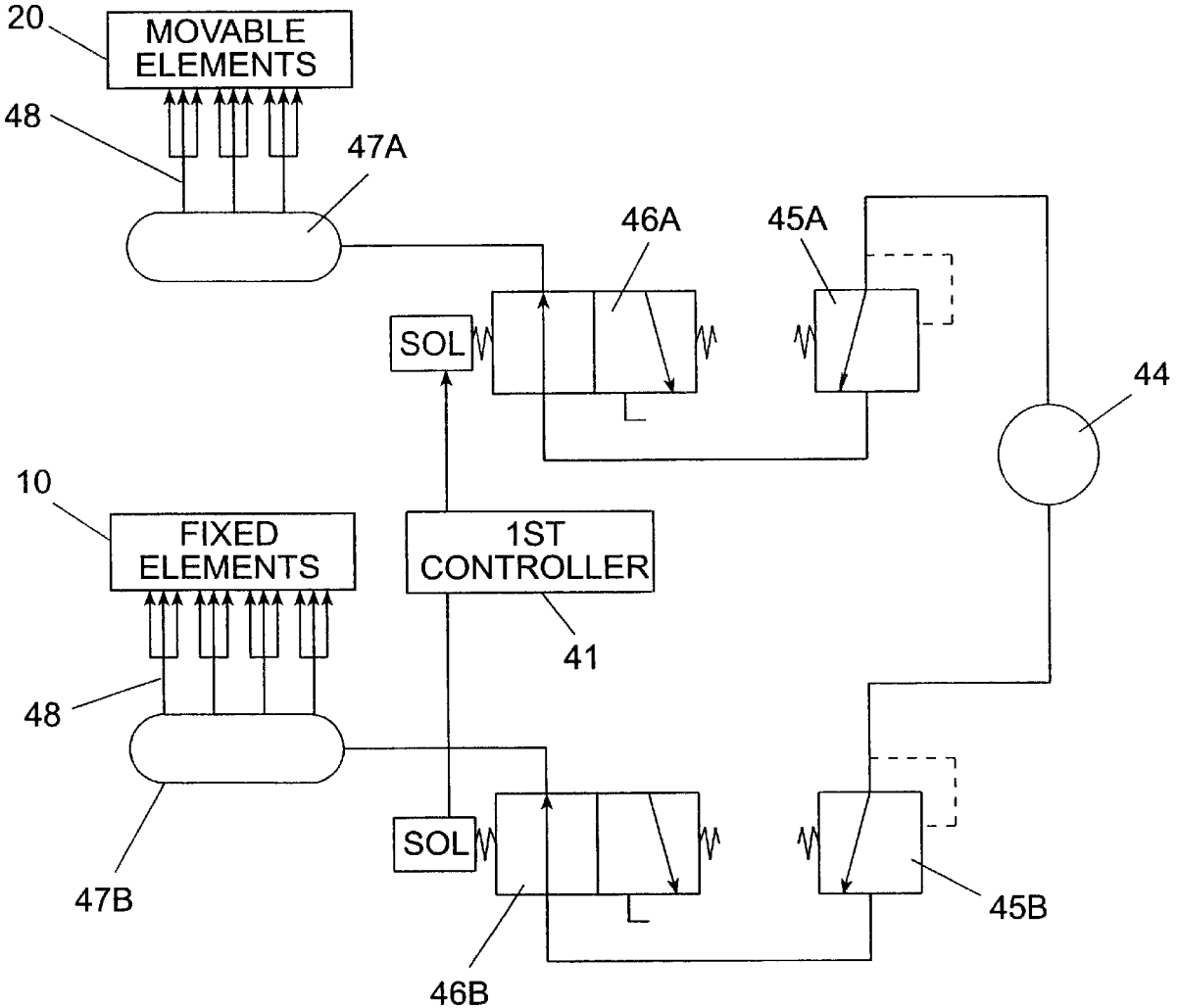
FIG. 6 is a block diagram of the vacuum operating system according to some embodiments of the present invention.

After the central controller 40 receives a command from the print controller 39 to start a new printing cycle, it sends an electronic command to the first controller 41 which in turn sends a command to the pneumatic valves 46 (see FIG. 6). The valves 46A apply a vacuum to the movable element 20, which grabs the web 8 and holds it tightly to the table's movable surface. The vacuum is supplied to the system by a vacuum pump 44. After the web 8 is firmly attached to the movable elements 20, valves 46B release the vacuum in the fixed elements 10. After applying and releasing the vacuum in valves 46A and 46B, short adjustable delays occur while the vacuum increases or decreases. The central controller 40 via second controller 43 then instructs the linear motor 31 to advance a step. This in turn moves the web print material 8 a predetermined distance, D, (FIG. 1B) forward.

The linear motor 31 is energized and pulls the movable elements 20 forward while the linear encoder 35 sends feedback data to the second controller 43. At the end of the forward step, the second controller 43 stops the linear motor 31. Valves 46B apply a vacuum to the fixed elements 10. The activation of valves 46B attaches the web to the fixed elements, readying it for the printing phase. After the web 8 is firmly attached to the fixed elements 10, the pneumatic valves 46A release the vacuum from the movable elements 20. The movable elements 20 return to their original position while the web is attached to the fixed elements 10. After the movable elements 20 have returned to their home position, a new cycle begins.

The closed-loop control mechanism comprising controller 43 and linear encoder 35 produces a step accuracy of a few microns. Is accuracy is required for butting the image 21 slices created during each step D.

Figure 5A:
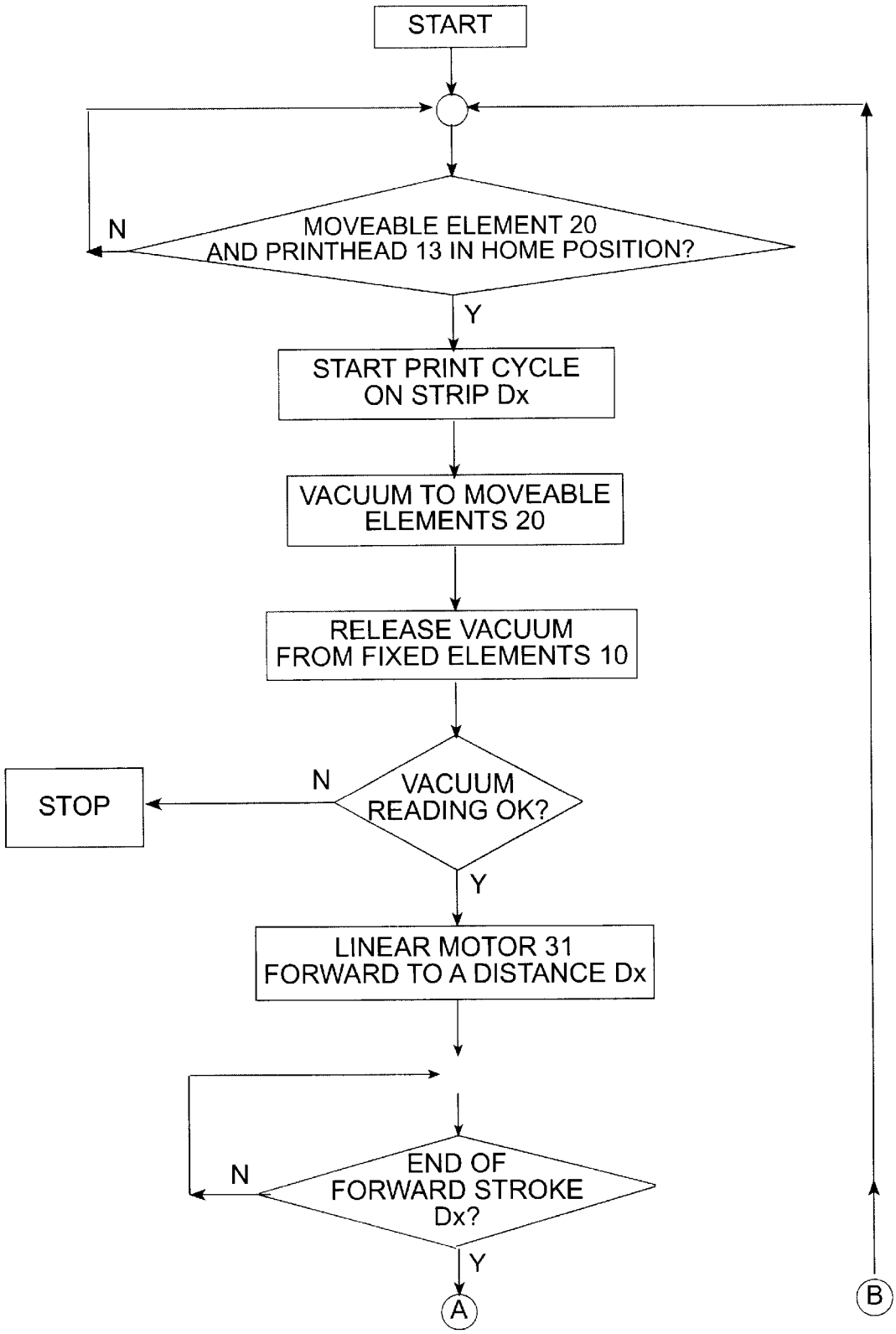
FIGS. 5A and 5B show a flow diagram of the control sequence operating the control and operation system according to some embodiments of the present invention.
Figure 5B:
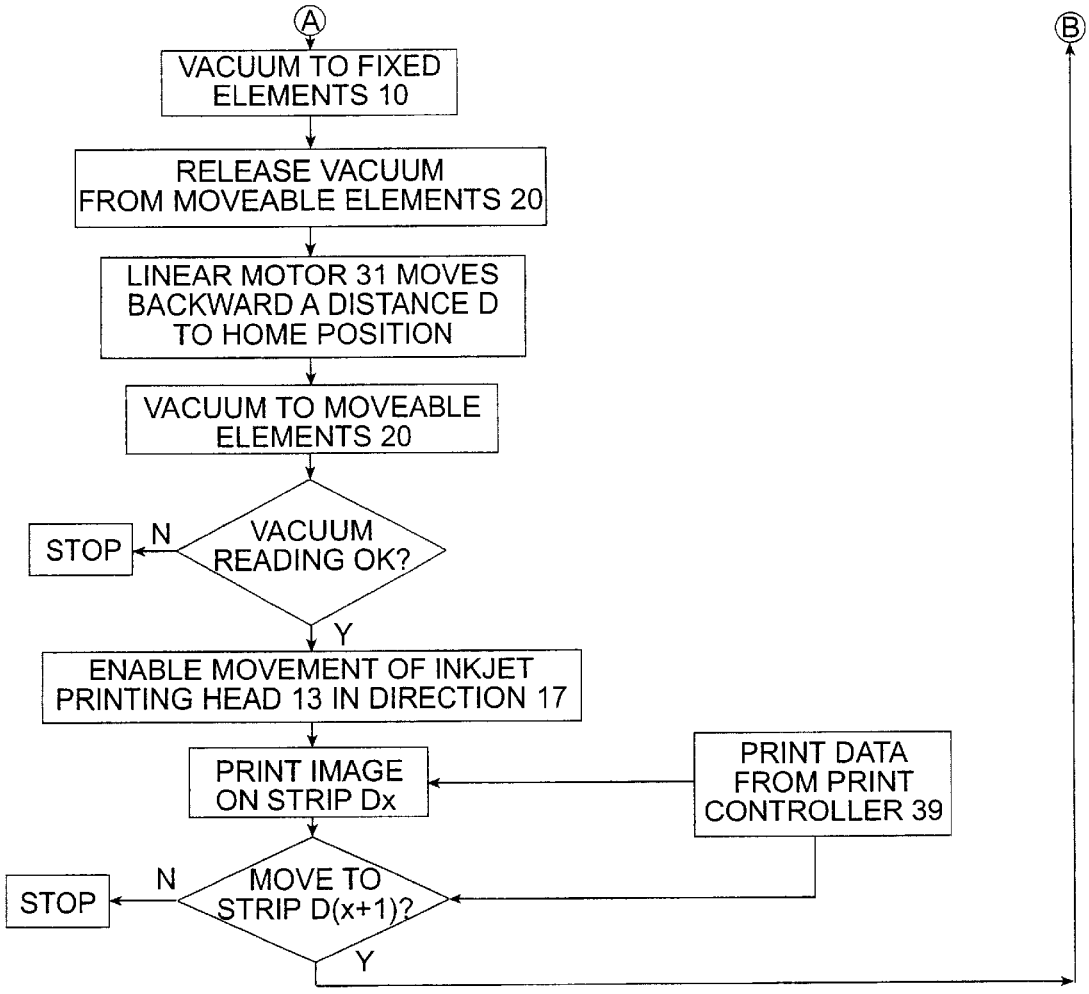

FIG. 5 shows a flow diagram of the control sequence of a complete operating cycle of the table 6 according to some embodiments of the present invention. Within the operating cycle, there is one printing phase per step $D_i$ (see FIG. 1B). Printing is performed when the web print material 8 is stationary and attached to the fixed elements 10.

FIG. 6 is a block diagram of the vacuum operating system according to some embodiments of the present invention. Vacuum pump 44 delivers a vacuum to two preset sequence valves 45A and 45B. As long as the pilot vacuum has not attained a preset level, the valves are closed. When the vacuum reaches the preset level, the valves open and deliver a vacuum to the lines that connect to valves 46A and 46B.

Valves 46A and 46B are two-position, three-way, solenoid-operated valves controlled by the first controller 41, which is in communication with the central controller 40. To move the web forward, a vacuum is delivered by 46A to the manifold 47A and then, via hoses 48, to the three pairs of vacuum inlets on each movable element 20. The inlets themselves are not shown. After the vacuum has been applied and the web 8 attached to the movable elements 20, the first controller 41 releases the vacuum from the manifold 47B through valve 46B freeing the web 8 from the fixed elements 10. In an analogous manner, to print and return the movable elements to their original position, a vacuum is delivered by 46B to the manifold 47B and then, via hoses 48, to the three pairs of vacuum inlets on each fixed element 10. After the vacuum has been applied and the web 8 attached to the fixed elements 10, the first controller 41 releases the vacuum from the manifold 47A through valve 46A freeing the web 8 from the movable elements 20. The vacuum system then holds web 8 securely to the fixed elements 10 permitting printing to occur while the movable elements 20 return to their original position. While the above discusses single valves at 45A, 45B, 46A and 46B, each can be replaced by multiple valves.

The table 6 described in this invention may be used to print a wide range of materials such as vinyl, paper, tissue-like paper, cardboard and metal. Essentially, the apparatus can be used to print on any flat material that can be held in place by an appropriate attachment mechanism.

The above embodiment discusses a web fed printing machine, but, in other printing embodiments, the print material transported may be sheets.

While the printing embodiment above describes the invention in terms of movement in precise unidirectional steps of uniform size, other embodiments of the invention can include conveying the material in multiple steps of uniform size or even in combinations of steps of different sizes. Moreover, the steps may be in a forward or backward direction or any combination thereof as required by the application.

The engagement system in the embodiment described above is a vacuum system. In other embodiments, other systems, such as an electrostatic system or a magnetic system, can be used. The primary requirement for an engagement system is that it must hold the material or objects being transported tightly during step acceleration and deceleration and during the processing which occurs between steps. This, to a large extent, is a function of the mass of the material being transported. The attachment mechanism must also be activated and deactivated within a reasonable response time.

More than a single vacuum system can be used for a particular embodiment. One vacuum system can control attachment of the material to the fixed elements while the other can control attachment of the material to the movable elements. The two systems must be properly synchronized.

In another embodiment, two different types of attachment systems can be used to convey the material, again with proper synchronization For example, the forces attaching the material to the fixed elements can be of electrostatic origin while those attaching the material to the movable elements can be produced by a vacuum system.

An important feature of this conveyance table is the almost complete absence of tension it exerts on the material being conveyed.

It is evident from the description of the embodiment above that the classical print registration problem has been transformed from a substrate dependent problem to one of mechanical design. Previously, the substrate determined the accuracy of print registration. Tension, stresses and non-uniformity of the substrate all affected registration accuracy. Similarly, environmental factors such as temperature and humidity contributed to undesirable variations in the substrate. The present invention has eliminated these variables. Because the material is never completely detached from the table on which printing or tooling occurs, the accuracy in step motion of the movable elements alone determines the accuracy of registration The present invention has been described above in terms of a conveyance apparatus for print material. It should be readily apparent that the principles embodied in the print conveyance apparatus described above—the step-wise movement of the elements, the aligned planar surface of the elements, the slidable engagement of the elements, the construction of the elements, the control systems for the elements and the to material being conveyed, the methods of attachment of the material being conveyed, among other aspects of the invention—can easily be adapted to conveyance apparatuses for other materials. In entirely different environments, the material conveyed can be metal sheets or foil, cardboard cartons, glass, metal or plastic objects, PCBs, etc. The present invention is particularly well suited for use in "pick and place" manufacturing processes such as those in the electronics industry.

Some embodiments of the present invention may be applied to a wide range of operations using many different materials and including a vast array of tools. In the above-described printing embodiments, the operative tool is a print head array. In other embodiments, different instruments, machines, devices or apparatuses can be used as the tool. Where sheet metal is the material being conveyed, the operative tool can be a hole puncher, a line etcher or any machine required to produce precise machining operations. In electronic operations, the operative instrument can be a fine spot welder or a laser ablation system. If metal foil is the material, a stamping machine can serve as the tool. In embodiments where cardboard is the material being conveyed, the operative tool can be a cutter.

According to some embodiments of the present invention, a method for adjusting the height of a table having a substrate thereon in order to adjust the distance between the substrate and a print head located above it is provided. In these embodiments, a z-direction movement mechanism may enable a vertical motion of the table, namely a motion in a direction perpendicular to its surface.

The table may be a large format table, such as a vacuum table weighting approximately 500 kg The Z-direction mechanism may enable the movement of such a table at small discrete steps of a few microns. The table may be table 6, which is described hereinabove or any other large format platform suitable for conveying a substrate placed thereon.

In some embodiments, which will be described hereinbelow with respect to FIGS. 7 and 8, the z-direction movement mechanism comprise eccentric shafts. However, it should be understood by persons skilled in the art that the description given herein is exemplary only, and the z mechanism may be implemented in other methods or with other elements not necessarily mentioned herein.

Non-limiting examples of such methods may include a method based on a hydraulic system and a pneumatic system using linear rails, pistons and ball screws or any other configuration capable of receiving instructions and responding with z-axis movement.

For clarity, the following description uses the example of a printing system. However, it will be appreciated by persons skilled in the art that some embodiments of the present invention may be applied to a wide range of systems comprising a movable tool for producing precise machining operations. Non-limiting examples of such tools include: a hole puncher, a line etcher, a fine spot welder, a laser ablation system, a cutter, a sprayer and a gluer.

Figure 7:
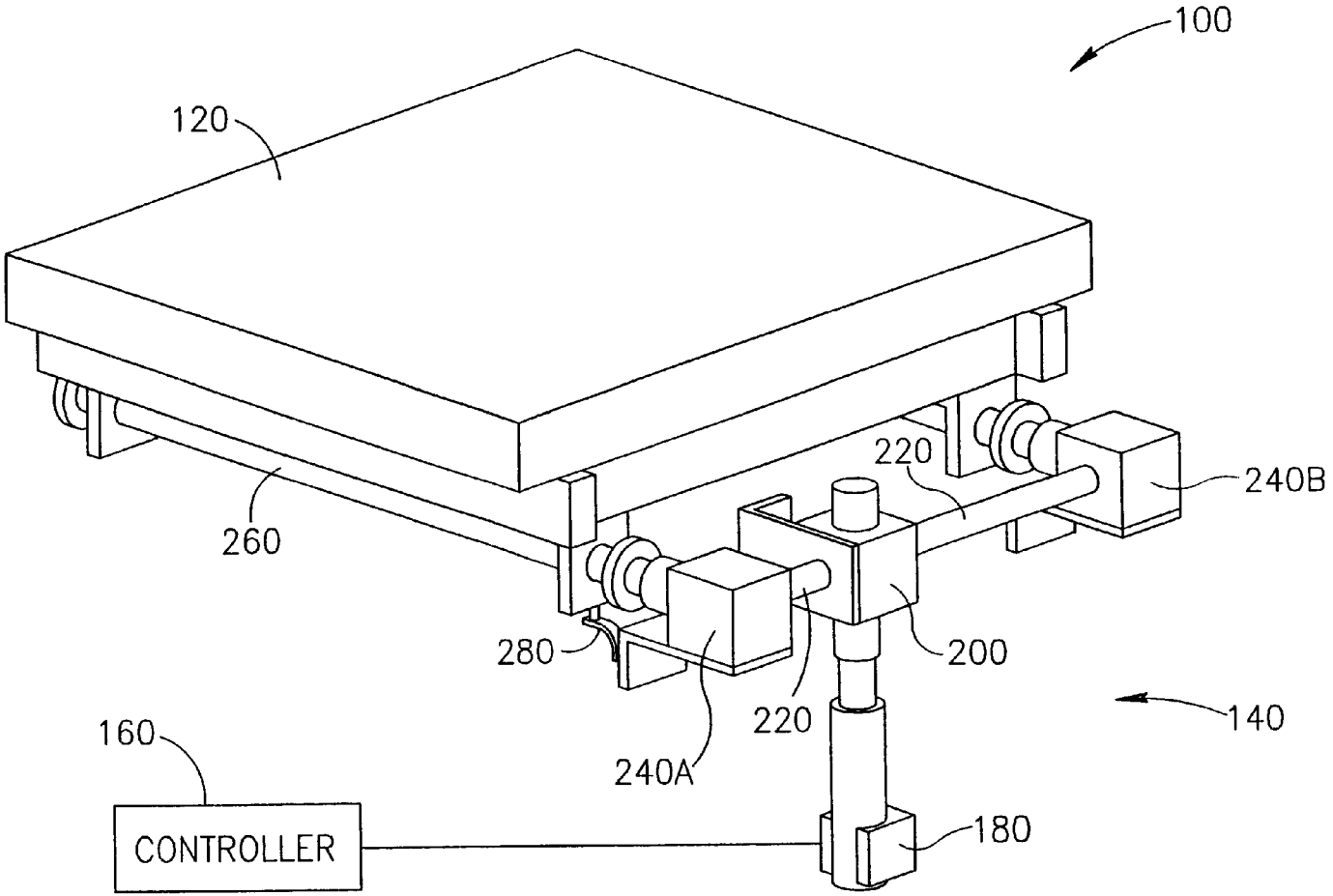
FIG. 7 is a perspective view of a table having a z-motion unit according to some embodiments of the present invention.
Figure 8:
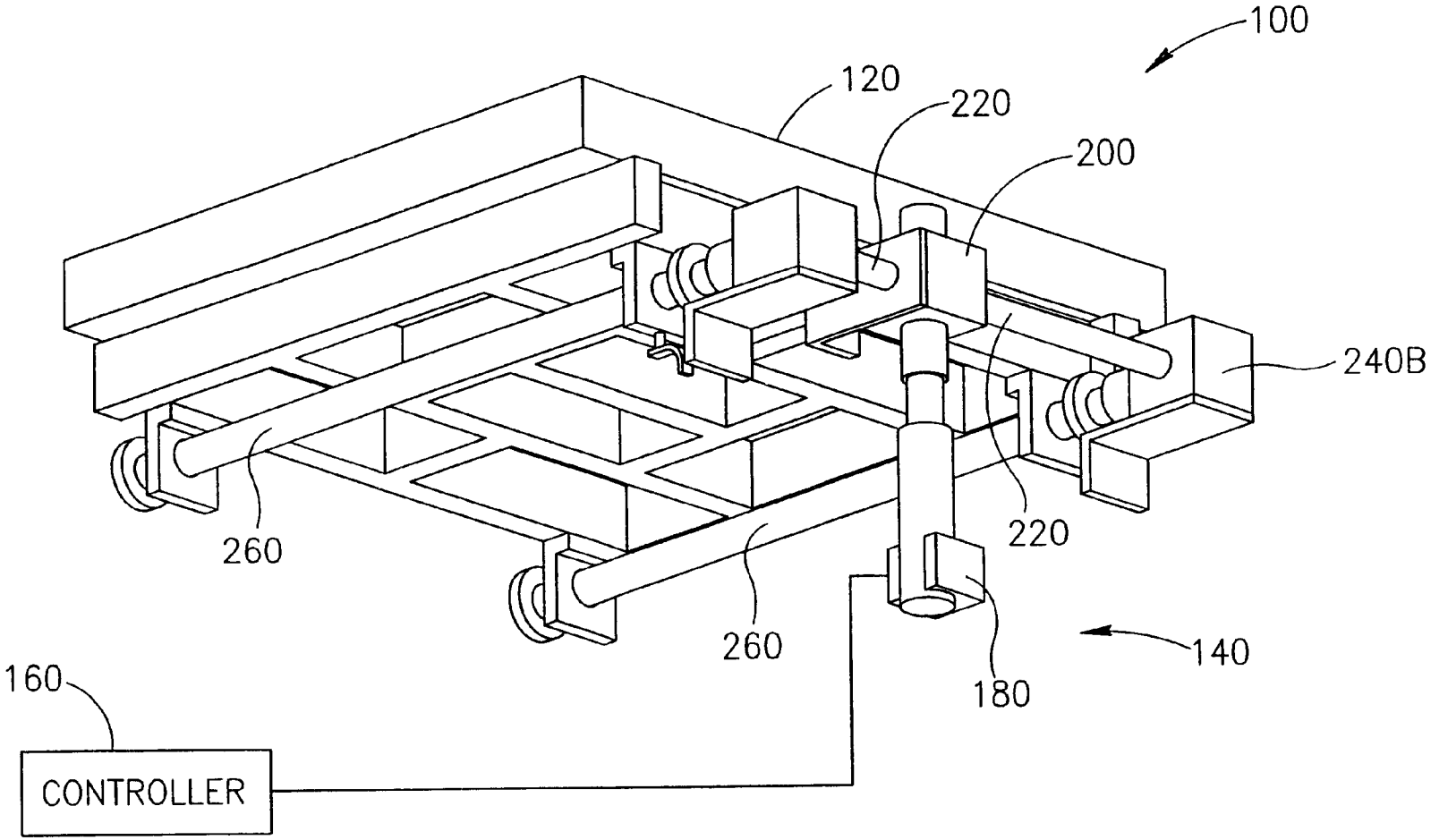
FIG. 8 is another perspective view of the table of FIG. 7 according to some embodiments of the present invention.

Reference is now made to FIG. 7, which show a perspective view of a system having a table coupled to a z-axis movement mechanism according to some embodiments of the present invention. FIG. 8 shows another perspective view of the system of FIG. 7. System 100 may comprise a table 120, a Z-axis movement mechanism 140 coupled to table 120 and optionally to a movement controller 160. Controller 160 may be coupled to other units of the system or may be a dedicated controller. Movement controller 240 may comprise a look-up table (LUT) (not shown) containing a list of user defined substrate thicknesses.

Z mechanism 140 may comprise a Z-axis motor 180 and a worn gear 200 coupled to Z-axis motor 180. Alternatively, Z-axis motor 180 and worm gear 200 may be constructed as a single unit elevator. Z-axis motor 180 may comprise an integrated encoder (not shown), such as, for example, a rotational encoder.

Z mechanism 140 may further comprise two drive shafts 220 coupled to worm gear 200, a right bevel gear 240A and a left bevel gear 240B, each coupled to a respective one of drive shafts 220. In order to achieve a desirable precision, the worm gear and the bevel gears may be high-precision zero backlash gears.

Z mechanism 140 may further comprise two eccentric shafts 260, each coupled to a respective bevel gear 240. Eccentric shafts 260 may generate a Her movement of table 120 in the Y-axis, thus creating an elliptical path of table 120, instead of simple linear path. The elliptical motion may also require a more complicated control method as will be described below.

The structure of Z mechanism 140 described hereinabove comprising a single z-motor 180 coupled to both eccentric shafts 260 may enable synchronized and coordinated movements of eccentric shafts 260.

Z mechanism 140 may further comprise an optical sensor 280. Sensor 280 may be positioned so as to indicate a low-level position of table 120. Sensor 280 may enable the calibration of the encoder within Z-axis motor 180 at the low-level position of table 120. The encoder may provide controller 160 data regarding the vertical positioning of table 120.

Controller 160 may perform calculations to calculate the required circular motion of motor 180 so that the elliptical motion of table 120 achieves the desired height. Controller 160 may then drive motor 180 according to said calculations. Alternatively, controller 160 may look up the required circular motion of motor 180 in a look-up table.

The process of adjusting the height of table 120 may be as follows:

Table 120 may be lowered to the low-level position according to information coming from sensor 280. Movement controller 160 may receive information regarding the thickness of the substrate to be printed on, and the desired distance between the print head and the substrate and may calculate the desired vertical position of table 120.

Alternatively, the LUT may contain an additional table listing the desired vertical position of table 120 for each selected substrate thickness. Typically, the desired vertical position is selected to achieve a desired distance of approximately 2 mm between the substrate and the print heads (not shown).

Controller 240 may then calculate the number of rotations that is needed for the selected vertical position of table 120. Depending on the calculation, controller 240 may transmit instructions to Z-axis motor 180 to rotate a certain number of rotations.

The rotation of Z-axis motor 180 either clockwise or counter clockwise, may cause worm gear 200 to move table 120 up to the desirable height.

While certain fetes of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A method comprising:

adjusting the height of a top rigid platform of a table-like structure having a substrate thereon in order to adjust the distance between a top surface of said substrate and an ink-jet print head located above said substrate.

2. The method of claim 1, further comprising: determining a desired height based upon a desired distance between the top surface and the print head and substrate thickness, which is stored in a look-up table.

3. The method of claim 1, wherein adjusting said height comprises adjusting said height in discrete steps of less than 20 microns.

4. The method of claim 1, wherein adjusting the height comprises:

lowering said platform to a predefined position according to information coming from a sensor;

calculating the number of motor rotations that is needed to move said platform to a desired height; and instructing a motor to rotate according to said number.

5. An ink-jet printing system comprising:

a table-like structure having a top rigid platform to support a substrate; and a motion unit able to alter the height of said platform such that the distance between a top surface of said substrate and an ink-jet print head located above said substrate is adjusted.

6. The ink-jet printing system of claim 5, farther comprising:

a controller able to drive said motion unit.

7. The ink-jet printing system of claim 6, wherein said controller comprises a look-up table containing a list of values of substrate thickness.

8. The ink-jet printing system of claim 5, wherein said motion unit is able to alter said height in discrete steps of less than 20 microns.

9. The ink-jet printing system of claim 5, wherein said motion unit comprises:

two eccentric shafts; and a single rotational motor coupled to said shafts.

10. The ink-jet printing system of claim 5, wherein said table-like structure is a vacuum table.

11. The ink-jet printing system of claim 5, wherein said motion unit further comprises an optical sensor positioned so as to indicate a predefined low-level position of said platform.

* * * * *